US009708783B1

(12) United States Patent
Smith

(10) Patent No.: US 9,708,783 B1
(45) Date of Patent: Jul. 18, 2017

(54) PLOW LOCK

(71) Applicant: Lawrence Smith, Franklin, MA (US)

(72) Inventor: Lawrence Smith, Franklin, MA (US)

( * ) Notice: Subject to any disclaimer, the term of this patent is extended or adjusted under 35 U.S.C. 154(b) by 162 days.

(21) Appl. No.: 14/792,692

(22) Filed: Jul. 7, 2015

(51) Int. Cl.
*E01H 5/06* (2006.01)

(52) U.S. Cl.
CPC ..... *E01H 5/061* (2013.01)

(58) Field of Classification Search
CPC ..... E01H 5/061
USPC ..... 70/14, 58, 94, 416
See application file for complete search history.

(56) References Cited

U.S. PATENT DOCUMENTS 1,098,954 A * 6/1914 Meyer ..... B60R 25/086 70/14
1,215,837 A * 2/1917 Needham ..... B60R 25/005 70/14
1,318,443 A * 10/1919 Gimperling ..... B60R 25/005 70/14
1,333,878 A * 3/1920 Smith ..... B60R 25/02 70/14
1,382,189 A * 6/1921 Harris ..... B60R 25/022 70/14
1,426,534 A * 8/1922 Baker ..... B60R 25/09 70/14
2,720,102 A * 10/1955 Spain ..... E05C 19/182 70/131
4,141,569 A 2/1979 Dilk
4,380,160 A 4/1983 Hoffman
D272,041 S * 1/1984 Harris ..... D8/330
4,538,435 A * 9/1985 Romero ..... B60R 25/02 70/183
4,616,490 A * 10/1986 Robbins ..... G11B 33/005 70/14
4,655,057 A * 4/1987 Derman ..... G11B 23/049 360/137
4,658,609 A * 4/1987 Mickelson ..... B60R 25/02 70/183
5,076,368 A * 12/1991 Harrell ..... A01B 15/14 172/127
D324,167 S * 2/1992 Greco ..... D8/331
5,265,448 A * 11/1993 Fontenot ..... E05C 19/18 16/223
5,765,408 A * 6/1998 Sanseverino ..... B60R 25/02147 70/14
5,961,140 A 10/1999 Huskey
5,983,684 A * 11/1999 Boisvert ..... B60R 25/00 70/14
6,155,086 A * 12/2000 Miller ..... B60R 25/021 70/14

(Continued)

*Primary Examiner* — Suzanne Barrett
(74) *Attorney, Agent, or Firm* — Kyle A. Fletcher, Esq.

(57) ABSTRACT

The plow lock is a device that is adapted for use with a plow or a snowplow in order to immobilize the plow or snowplow from use. The plow lock includes a first plate affixed to a second plate. The second plate forms a right angle with the first plate. The first plate includes a first lock hole thereon. The second plate is further defined with an outer surface. The outer surface of the second plate is affixed to a wedge member. The wedge member extends outwardly from the second plate. The plow attachment bracket includes a plow lock hole that aligns with the first lock hole of the first plate such that a lock is locked thereon so as to secure the plow lock onto the plow attachment bracket thereby preventing a vehicle from attachment to the plow attachment bracket.

15 Claims, 3 Drawing Sheets

(56) References Cited

U.S. PATENT DOCUMENTS 6,237,377 B1 * 5/2001 Vasquez, Sr. ..... E05C 19/184 292/167
6,327,878 B1 * 12/2001 Levenson ..... E05C 19/182 292/288
6,434,979 B1 * 8/2002 Allen ..... B60R 25/06 70/14
6,598,432 B1 7/2003 Dwyer
6,672,115 B2 * 1/2004 Wyers ..... B60D 1/52 280/506
6,705,137 B2 * 3/2004 Saladin ..... B60R 25/001 70/14
6,874,338 B1 * 4/2005 Hunt ..... E02F 9/24 70/14
6,941,780 B1 * 9/2005 Marr ..... B60R 25/09 188/32
6,990,838 B2 * 1/2006 Witchey ..... B62D 49/04 172/272
7,051,558 B2 * 5/2006 Mathers ..... E05B 73/0076 70/14
7,059,019 B1 * 6/2006 Klingler ..... E05B 67/383 16/261
7,100,937 B2 9/2006 Hogan
7,165,348 B1 1/2007 Ward
7,237,410 B2 * 7/2007 Millist ..... B63B 35/7933 70/14
8,061,730 B2 11/2011 Bernart
8,220,820 B2 7/2012 Bow
D677,554 S * 3/2013 Stover, Jr. ..... D8/330
D678,034 S * 3/2013 Stover, Jr. ..... D8/330
D678,035 S * 3/2013 Stover, Jr. ..... D8/330
D680,415 S * 4/2013 Stover, Jr. ..... D8/330
8,707,537 B2 4/2014 Clark
2012/0180292 A1 * 7/2012 Clark ..... E01H 5/061 29/428
2012/0210754 A1 * 8/2012 Thomsen ..... E05B 13/002 70/14
2015/0000354 A1 * 1/2015 Orlov ..... E05C 17/025 70/14

* cited by examiner

PLOW LOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of snow plows, more specifically, a device that is able to lock onto a snow plow attachment bracket of a snow plow to prevent said snow plow from being stolen by being attached to a vehicle.

Snowplows are an essential piece of equipment for snow-covered roadways. A snowplow usually includes an attachment bracket that connects the working portion of the plow to a vehicle in order to use as a snowplow. Snowplows can be expensive, and when left unattached to a vehicle, may become an item that can be easily stolen. What is needed, and is accomplished in this patent application is a device that works to disable the attachment bracket of the snowplow so that a would-be thief would be foiled in stealing the snowplow.

SUMMARY OF THE INVENTION

The plow lock is a device that is adapted for use with a snowplow in order to immobilize the snowplow from use. The plow lock includes a first plate affixed to a second plate. The second plate forms a right angle with the first plate. The first plate includes a first lock hole thereon. The second plate is further defined with an outer surface. The outer surface of the second plate is affixed to a wedge member. The wedge member extends outwardly from the second plate. The first plate is further defined with a lower surface that is adapted to be positioned on a plow attachment bracket along with the wedge member. The plow attachment bracket includes a plow lock hole that aligns with the first lock hole of the first plate such that a lock is locked thereon so as to secure the plow lock onto the plow attachment bracket thereby preventing a vehicle from attachment to the plow attachment bracket.

It is an object of the invention to provide a device that is attached onto a snowplow attachment bracket of a snowplow thereby immobilizing the snowplow from use.

It is a further object of the invention to include a device that is highly portable, easy to install and remove, and is highly effective at rendering the snowplow inoperable or even able to be stolen.

These together with additional objects, features and advantages of the plow lock will be readily apparent to those of ordinary skill in the art upon reading the following detailed description of presently preferred, but nonetheless illustrative, embodiments of the plow lock when taken in conjunction with the accompanying drawings.

In this respect, before explaining the current embodiments of the plow lock in detail, it is to be understood that the plow lock is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the plow lock.

It is therefore important that the claims be regarded as including such equivalent construction insofar as they do not depart from the spirit and scope of the plow lock. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
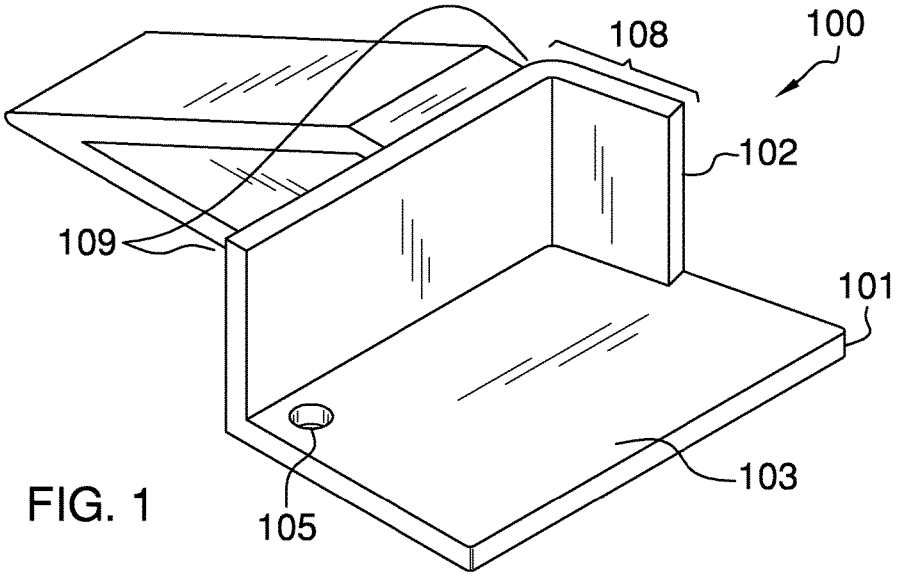
FIG. 1 is a front, perspective view of an embodiment of the disclosure.
Figure 2:
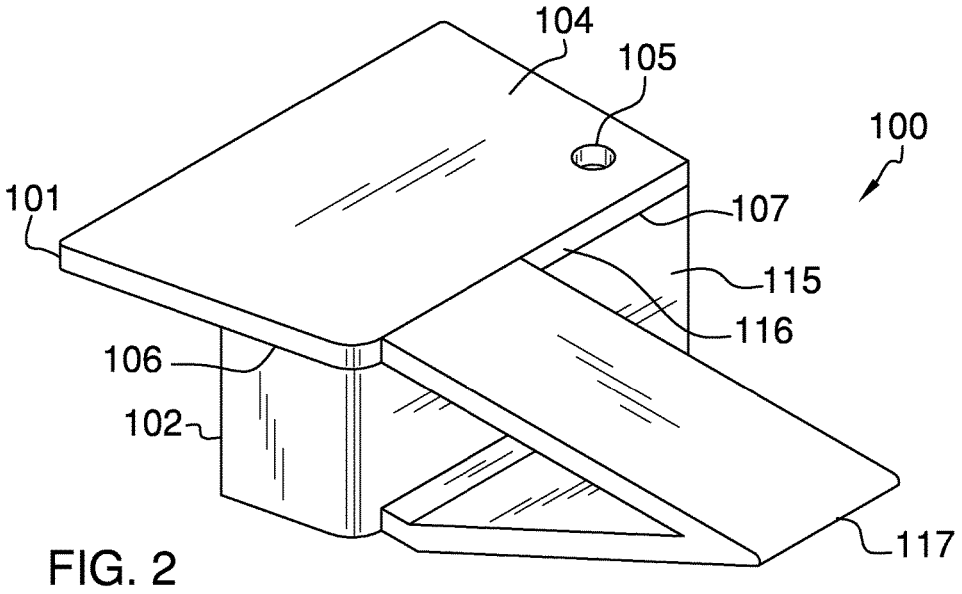
FIG. 2 is a rear, perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the plow lock 100 (hereinafter invention) generally comprises a first plate 101 that is affixed to a second plate 102. The second plate 102 forms a right angle with the first plate 101. The first plate 101 is a planar object, and is a polygonal shaped object. The first plate 101 is further defined with a third surface 103 and a fourth surface 104. The third surface 103 is opposite of the fourth surface 104.

The first plate 101 includes a first lock hole 105. The first lock hole 105 extends across both the third surface 103 and the fourth surface 104. The second plate 102 is affixed to the first plate 101 along a fifth edge 106 and a sixth edge 107. Moreover, the second plate 102 is affixed to the first plate 101 at the third surface 103. The second plate 102 may be further defined as a seventh portion 108 and an eighth portion 109. The seventh portion 108 extends along the fifth edge 106 of the third surface 103 of the first plate 101. The eighth portion 109 extends along the sixth edge 107 of the third surface 103 of the first plate 101.

The first lock hole 105 is located adjacent the sixth edge 107 of the first plate 101. Moreover, the first lock hole 105 is positioned a first lock distance 110 from the eighth portion 109 of the second plate 102. The first lock hole 105 is also positioned a second lock distance 111 from a tenth edge 112 of the first plate 101. The first lock distance 110 and the second lock distance 111 are specific to the use of the invention 100 with respect to a snowplow 200. As a side note, the term "plow" is being used to refer to a snowplow or a plow, more generally. The first lock hole 105 is also further defined with an inner diameter 113, which is also specific to the snowplow 200.

The second plate 102 and the first plate 101 form a second height 114, which is not less than 2 inches. Moreover, the second height 114 is also specific to the snowplow 200. The eight portion 109 of the second plate 102 is further defined with a second outer surface 115. The second outer surface 115 is aligned with a first outer surface 116 of the first plate 101. The first outer surface 116 and the third surface 103 form the sixth edge 107 of the first plate 101.

Figure 3:
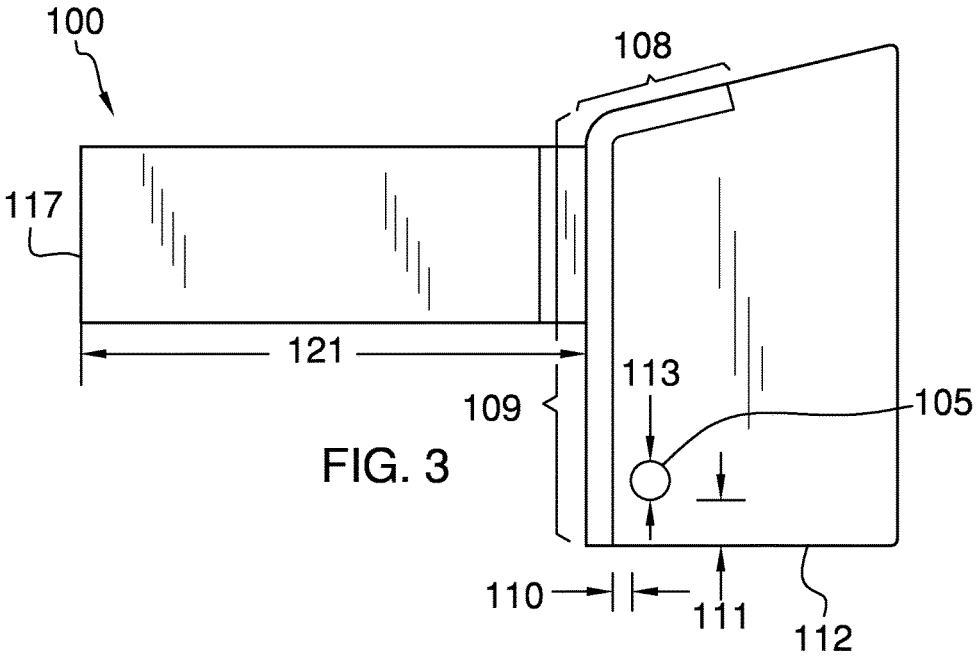
FIG. 3 is a top view of an embodiment of the disclosure.
Figure 4:
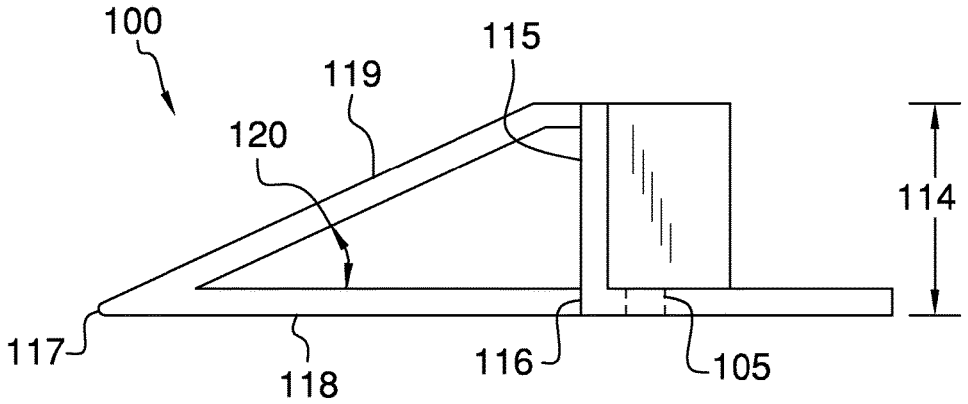
FIG. 4 is a front view of an embodiment of the disclosure.

The invention 100 includes a wedge member 117. The wedge member 117 extends outwardly from the first plate 101 and the second plate 102. Moreover, the wedge member 117 is affixed to both the second outer surface 115 as well as the first outer surface 116. Referring to FIGS. 3 and 4, the wedge member 117 is further defined as a horizontal member 118 and a diagonal member 119. The horizontal member 118 extends outwardly from the first outer surface 116 of the first plate 101; whereas the diagonal member 119 extends downwardly from the second outer surface 115 of the second plate 102. The wedge member 117 forms an angle 120 between the horizontal member 118 and the diagonal member 119. The wedge member 117 extends a wedge length 121 outwardly from the first plate 101 and the second plate 102. The wedge length 121 is specific to the snowplow 200.

Figure 5:
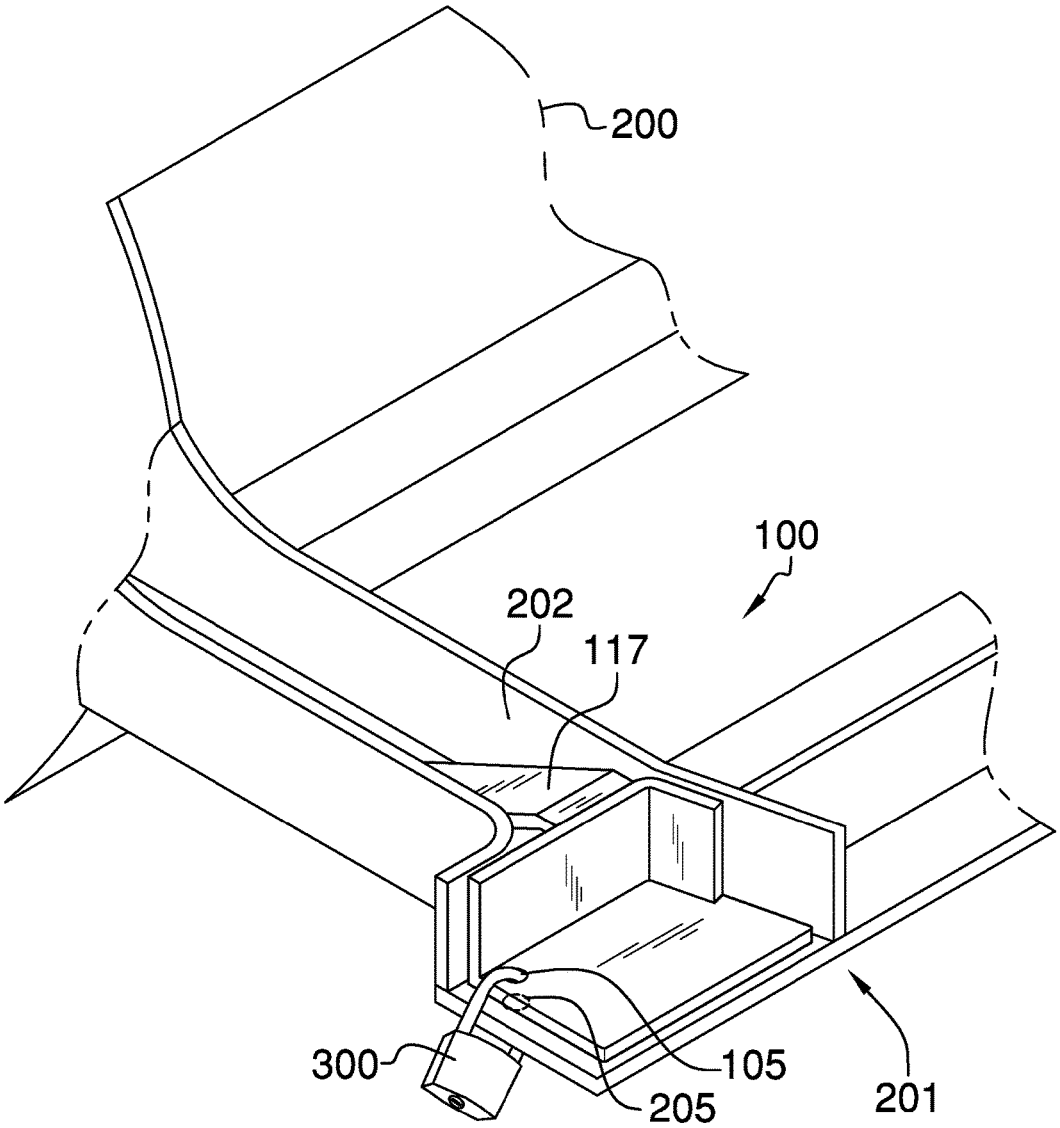
FIG. 5 is a perspective view of an embodiment of the disclosure in use.

Referring to FIG. 5, the invention 100 is able to be locked onto a plow attachment bracket 201 of the snowplow 200. Moreover, the plow attachment bracket 201 is a portion of the snowplow 200 that normally hooks onto a vehicle (not depicted) when in use as a plow or snowplow. The plow attachment bracket 201 includes at least one female receptacle 202. The at least one female receptacle 202 is attachable to the vehicle (not depicted). The invention 100 is able to slide into the at least one female receptacle 202. Moreover, the wedge member 117 slides into the at least one receptacle 202, and a lock 300 is used to secure the invention 100 to the plow attachment bracket 201. The plow attachment bracket 201 includes a plow lock hole 205 that is aligned with the first lock hole 105 of the first plate 101. The lock 300 secures the invention 100 in place so as to make attachment of the snowplow 200 to a vehicle (not depicted) not possible.

The first plate 101, the second plate 102, and the wedge member 117 may be made of a metal. Moreover, the invention 100 may be molded of a single piece of material.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A plow lock comprising:

a wedge member that is adapted to be inserted and nested into at least one female receptacle of a plow attachment bracket of a snowplow in order to render disabled the snowplow thereby securing the snowplow against theft;

wherein the wedge member is affixed to a first plate and a second plate;

wherein the second plate forms a right angle with the first plate;

wherein the first plate is a planar object, and is a polygonal shaped object;

wherein the first plate is further defined with a third surface and a fourth surface;

wherein the third surface is opposite of the fourth surface;

wherein the first plate includes a first lock hole;

wherein the first lock hole extends across both the third surface and the fourth surface;

wherein the second plate is affixed to the first plate along a fifth edge and a sixth edge.

2. The plow lock according to claim 1 wherein the second plate is affixed to the first plate at the third surface; wherein the second plate is further defined as a seventh portion and an eighth portion.

3. The plow lock according to claim 2 wherein the seventh portion extends along the fifth edge of the third surface of the first plate.

4. The plow lock according to claim 3 wherein the eighth portion extends along the sixth edge of the third surface of the first plate.

5. The plow lock according to claim 4 wherein the first lock hole is located adjacent the sixth edge of the first plate; wherein the first lock hole is positioned a first lock distance from the eighth portion of the second plate.

6. The plow lock according to claim 5 wherein the first lock hole is also positioned a second lock distance from a tenth edge of the first plate.

7. The plow lock according to claim 6 wherein the first lock hole is also further defined with an inner diameter.

8. The plow lock according to claim 7 wherein the second plate and the first plate form a second height, which is not less than 2 inches.

9. The plow lock according to claim 8 wherein the eight portion of the second plate is further defined with a second outer surface; wherein the second outer surface is aligned with a first outer surface of the first plate.

10. The plow lock according to claim 9 wherein the first outer surface and the third surface form the sixth edge of the first plate.

11. The plow lock according to claim 10 wherein the wedge member extends outwardly from the first plate and the second plate; wherein the wedge member is affixed to both the second outer surface as well as the first outer surface.

12. The plow lock according to claim 11 wherein the wedge member is further defined as a horizontal member and a diagonal member; wherein the horizontal member extends outwardly from the first outer surface of the first plate; wherein the diagonal member extends downwardly from the second outer surface of the second plate.

13. The plow lock according to claim 12 wherein the wedge member forms an angle between the horizontal member and the diagonal member; wherein the wedge member extends a wedge length outwardly from the first plate and the second plate.

14. The plow lock according to claim 13 wherein the wedge member slides into the at least one female receptacle, and a lock is used to secure the first plate to the plow attachment bracket.

15. The plow lock according to claim 14 wherein the plow attachment bracket includes a plow lock hole that is adapted to be aligned with the first lock hole of the first plate.

* * * * *